US005174639A

United States Patent [19]

Wong

[11] Patent Number: 5,174,639

[45] Date of Patent: Dec. 29, 1992

[54] ELECTRONIC PIANO CABINET CONSTRUCTION

[76] Inventor: Myndilee Wong, 217 16th St. NW., Canton, Ohio 44703

[21] Appl. No.: 733,159

[22] Filed: Jul. 19, 1991

[51] Int. Cl.[5] ..... A47B 91/00

[52] U.S. Cl. ..... 312/351.3

[58] Field of Search ..... 84/DIG. 17, 79, 183; 312/223, 255, 256, 194, 7.2

[56] References Cited

U.S. PATENT DOCUMENTS

| | | | |
|---|---|---|---|
| 2,113,045 | 4/1938 | Evans | 84/DIG. 17 |
| 3,635,172 | 1/1972 | Ball et al. | 312/223 X |
| 4,163,867 | 8/1979 | Breidenbach | 312/223 X |
| 4,406,205 | 9/1983 | Paray | 84/183 |

*Primary Examiner*—Joseph Falk

[57] ABSTRACT

An electronic piano cabinet is disclosed in which the interior of the cabinet is divided into a series of enclosures for housing portions of sound recording equipment and sound reproducing equipment. Also, the cabinetry includes portions which include fiber optic display devices and means for accommodating said fiber optic equipment for the production of visual effects. Also included are means for communicating with the interior of the equipment through supporting members of the cabinetry to provide for the transmission of the fiber optic means to locations remote from the cabinetry as well as means for wiring remote sound reproducing equipment such as loud speakers.

6 Claims, 4 Drawing Sheets

ELECTRONIC PIANO CABINET CONSTRUCTION

BACKGROUND OF THE INVENTION

1. Field of the Invention

The present invention relates to musical instruments and more specifically the invention relates to electronic pianos and sound producing equipment. Even more specifically, the invention relates to a cabinet construction for a storage, housing and playing access for an electronic keyboard and sound producing and reproducing equipment, and associated visual display equipment.

2. Description of the Prior Art

In years past, it was common for a family to have a piano as a part of the furnishing for the family residence. Numerous kinds of pianos have, of course, been available over the years, including the traditional grand piano style, upright styles, and other styles known as a spinet. Because of the large nature of pianos and of the way in which pianos are constructed they occupied a great deal of floor space. This is particularly true of grand pianos. Therefore, in today's homes, it is rare for one to encounter a grand piano, unless the particular residence is much larger than the normal sized home.

Also, in recent years, various types of the electronic sound producing equipment have become commonly available. This electronic equipment is capable of either producing or reproducing very accurately the sound of various musical instruments, including pianos, guitars, organs and numerous other musical instruments. This electronic equipment includes complete sound systems which might have AM-FM radio receivers, compact disc players, tape recording and play-back equipment, amplifiers, and loud speaker systems. In particular, electronic keyboard equipment is available which is capable of producing a wide variety of sounds. These electronic keyboards can produce desired reproduction of musical instruments that range from organs to pianos. Numerous other types of musical instruments such as drums can also be simulated. The capabilities of sound reproduction are basically limited only by the input device which is used to produce the sound desired.

The electronic keyboard supporting devices generally available are primarily purely functional devices, that is, a device which serves only to position the keyboard at a convenient location where it may be operated by a person using the equipment.

Accordingly, electronic keyboard equipment has been rather unpleasing in appearance and does not lend a particularly aesthetic appearance to the interior decor of a family residence.

In more recent years, the use of visual displays in association with audio reproduction or production equipment has become quite common. For example, commercial music establishments, such as discos, are normally equipped with a wide variety of visual displays which operate either in connection with or as an adjunct to the sound or music played in the particular establishment. The use of such visual displays, however, is not confined to commercial establishments. In some residential sound equipment installations, visual equipment may be used to enhance the enjoyment of the music.

Because of the nature of available equipment and their functional character, particularly when considering the so-called High Tech stereo equipment, the equipment installations leave much to be desired from an aesthetic standpoint. Likewise, with respect to the electronic keyboard type equipment, the functional character of available equipment precludes its materially adding any aesthetic enhancement to the installation of the currently available sound producing or reproducing equipment.

There, of course, are many types of cabinetry available which are specifically designed to accommodate stereo equipment, which in many cases also includes a television receiver. However, I am unaware of any cabinetry type equipment that fulfills a number of desired characteristics for the housing and use of a wide variety of sound producing and reproducing equipment. Specifically, I am aware of no available equipment which simulates the appearance of a traditional piano and which at the same time provides for the housing and operability of other sound equipment, such as stereo equipment and visual display equipment.

Accordingly, it is a primary object of the present invention to provide a construction for housing and supporting an electronic keyboard and associated equipment, which cabinet is in general appearance similar to a traditional piano.

A further object of the present invention is to provide such a construction which also includes means for mounting and housing high fidelity stereo equipment, such as radio receivers, amplifiers, compact disc players, tape equipment, power supply equipment, and other related sound equipment.

It is a still further object of the present invention to provide a construction as set forth above which also includes a provision for the installation of visual display equipment both as a part of the cabinetry itself and externally at a remote location from the equipment.

It is a still further object of the present invention to provide a cabinet for housing an electronic sound system which includes uniquely shaped members that support the cabinetry upon the floor at a desired installation location, and which also includes means for providing access to and communication with the interior of the cabinetry, and which also are in the form of aesthetically coordinated devices used in association with the production or reproduction of sound and music.

SUMMARY OF THE INVENTION

These and other objects and advantages will become apparent from the following description of the electronic piano cabinet construction of the present invention, the general nature of which may be stated as a cabinet member that is formed in the general shape of a traditional piano and which includes an electronic keyboard support member in the form of a movable platform. The interior of the cabinet is subdivided into a series of enclosures for housing portions of the sound reproducing system and may include radio receivers, tape equipment, compact disc equipment, speakers, and the like. The cabinetry device also includes portions which are adapted to house fiber optic equipment for the production of visual effects, both at the cabinet location or at a location remote from the cabinet. The construction also includes supporting members or legs which may be formed in unique designs to add aesthetic appeal beyond the normal function of a cabinet leg and, for example, may be in the shape of a metronome, fountain pen, a stack of books, or other desired designs. The supporting members also include conduits or passages which communicate with the interior of the cabinet construction to provide a means of providing electrical power to the equipment housed in the cabinetry, and as a means of transmitting fiber optics to locations remote from the cabinetry, and as a means of wiring loud speakers or the like at positions remote from the cabinetry, all communication and transmission being accomplished without the equipment being visible to the observer.

DESCRIPTION OF THE PREFERRED EMBODIMENT

A preferred embodiment of the present invention is illustrated in the accompanying drawings. The advantageous, new and useful results obtained thereby are contained in the following description and claims.

In the drawings.

Similar numerals refer to similar parts throughout the various figures of the drawings.

Figure 1:
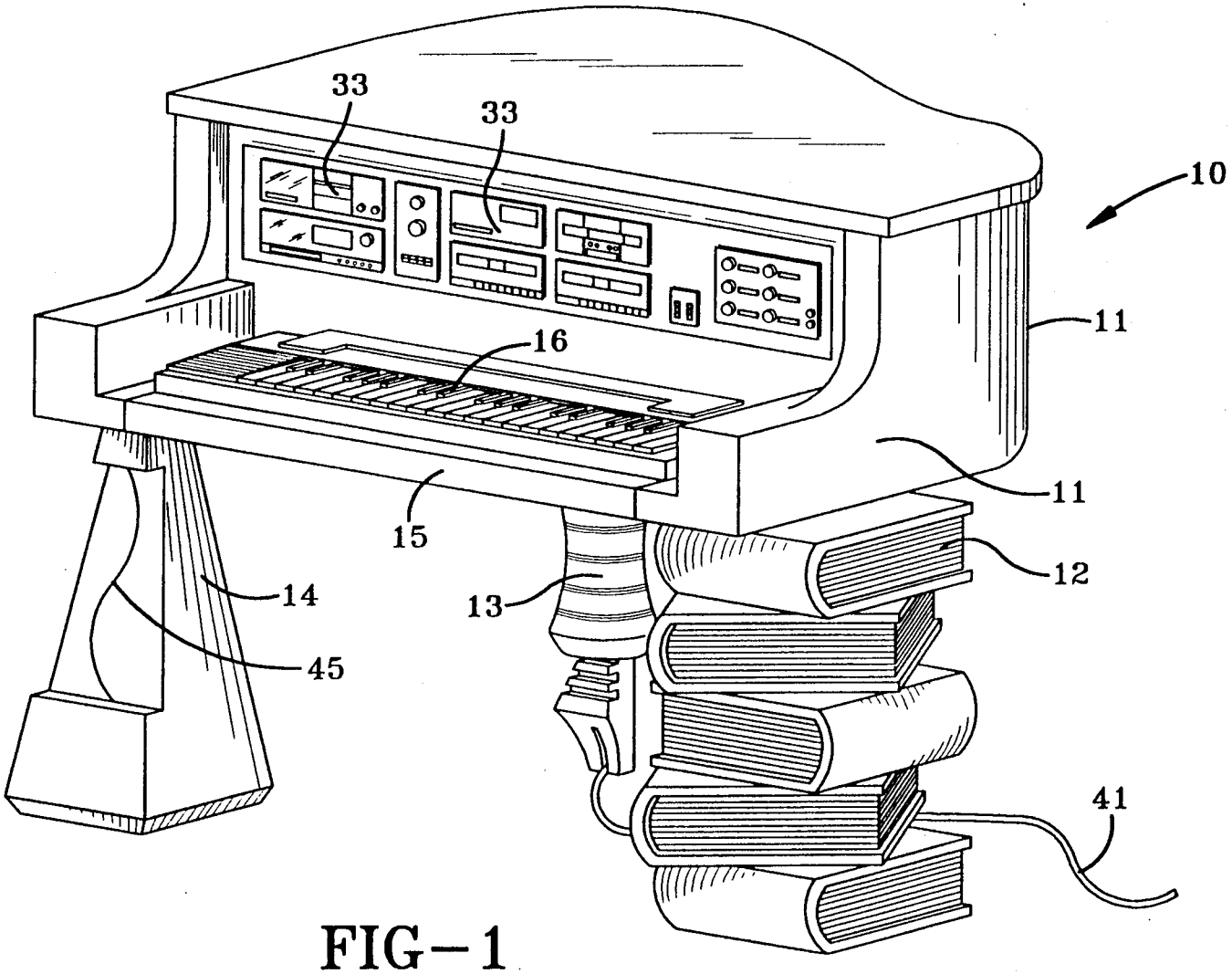
FIG. 1 is a perspective view of the electronic piano cabinet construction of the present invention.

Referring specifically to FIG. 1, an electronic piano cabinet construction is generally indicated at 10 and includes a generally piano shaped cabinet housing member 11 supported by a plurality of legs 12, 13 and 14. The cabinet also includes a slidable platform 15 which supports a keyboard of a commercially available keyboard system. The keyboard and electronic equipment are sometimes referred to in the art as a synthesizer, and it is to be understood that this expression is contemplated as not exclusive, for the purposes of the present invention, of any electronic equipment, operated by a keyboard or other key type devices which will produce sound through the electronic components and a loud speaker system.

Cabinet member 11, as illustrated, is in the shape of a grand piano. However, the over-all size of the cabinet of the present invention is considerably smaller than a normal grand piano. The particular size of the cabinet construction of the present invention, however, is not limited to any particular size which is smaller than a standard grand piano. The primary factor in determining the size of the cabinet construction of the present invention is the size of the equipment to be housed therein, as well as the size of the keyboard to be supported on the cabinet platform.

Figure 4:
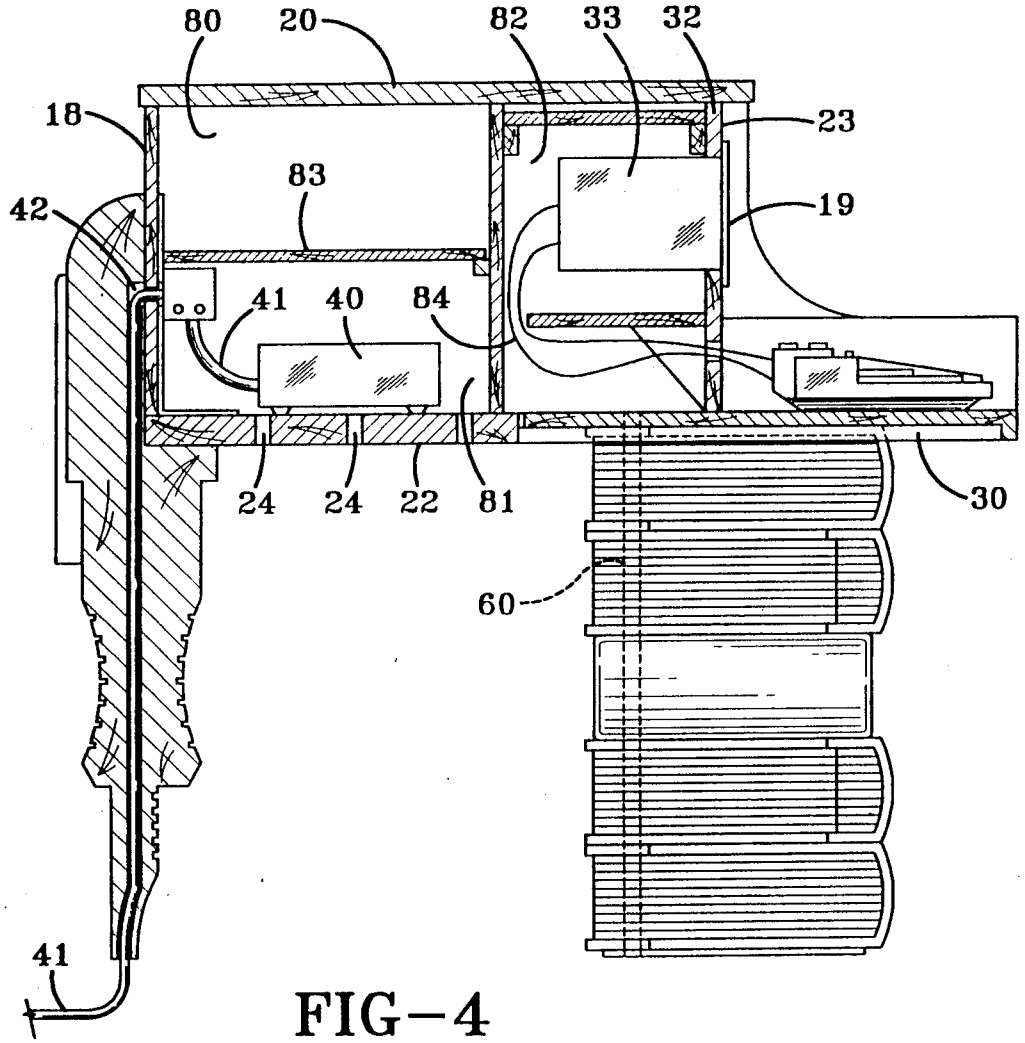
FIG. 4 is a vertical section taken on lines 4—4 of FIG. 3.

Housing member 11 also includes a generally flat vertically extending right side wall 17, a rear wall 18, and a flat left side wall 19. Rear wall 18 is illustrated as being S-curved, but any desired shape may be used in alternate constructions. A cabinet top 20 is also provided which is hinged as at 21 so that the top 20 may be opened to gain access to the interior of the cabinet formed by side walls 17 and 19 and rear wall 18. The cabinet also includes a bottom wall 22 and a front panel 23 which forms the housing for the electronic equipment. As illustrated, the interior of the cabinet formed by side walls 20 and 22, and front panel 23 may be divided into smaller compartments, as best seen in FIG. 4, and to be described in more detail below. The bottom wall may also be provided with a series of vent holes 24 which provide ventilation for the electronic equipment located within the interior of the cabinet so that this equipment does not become overheated.

In accordance with the present invention, slidable platform 15 is mounted and extends outwardly from the lower end of front panel 23, as best seen in FIG. 4. The sliding may be accomplished by any means, as for example, by a pair of extension glides which are commercially available and may be of the type commonly seen in kitchen cabinetry. These extension glides are generally indicated by reference numeral 30.

Front panel 23 may be provided with a series of openings as at 32 in which various items of electronic sound equipment diagrammatically illustrated at 33 in FIG. 4 may be mounted. These items of equipment may include an AM-FM radio receiver or tuner, an amplifier, compact disc player, a tape recording and playback equipment, graphic equalizer equipment, and the like. These items of electronic equipment are commercially available and the particular arrangement and mounting in openings 32 will be determined by the particular shape and size of the items to be mounted in front panel 23. Also, speakers may be mounted within front panel 23 and, while not illustrated, it is to be understood that the mounting of speakers of suitable size in suitable openings in front panel 23 will be in a manner similar to that of other items of electric equipment illustrated in the drawings. If desired, front panel 23 may be plain or provided with suitable artistic decor.

Keyboard member 16, which is also illustrated in a diagrammatic fashion, is of a type that is commercially available and is mounted on sliding platform 15. The sliding platform is provided for several purposes, the first of which is to permit the keyboard to be moved away from front panel 23 so that various wire connections may be made between keyboard 16 and other associated equipment housed within the interior of the cabinet or housing 11. Also, the slidable movement of platform 15 on which keyboard 16 is supported permits movement of the keyboard to a position within easy reach of an individual who wishes to operate the keyboard at its most convenient position. Also, sliding platform 15 may accommodate various brands of keyboards.

Figure 2:
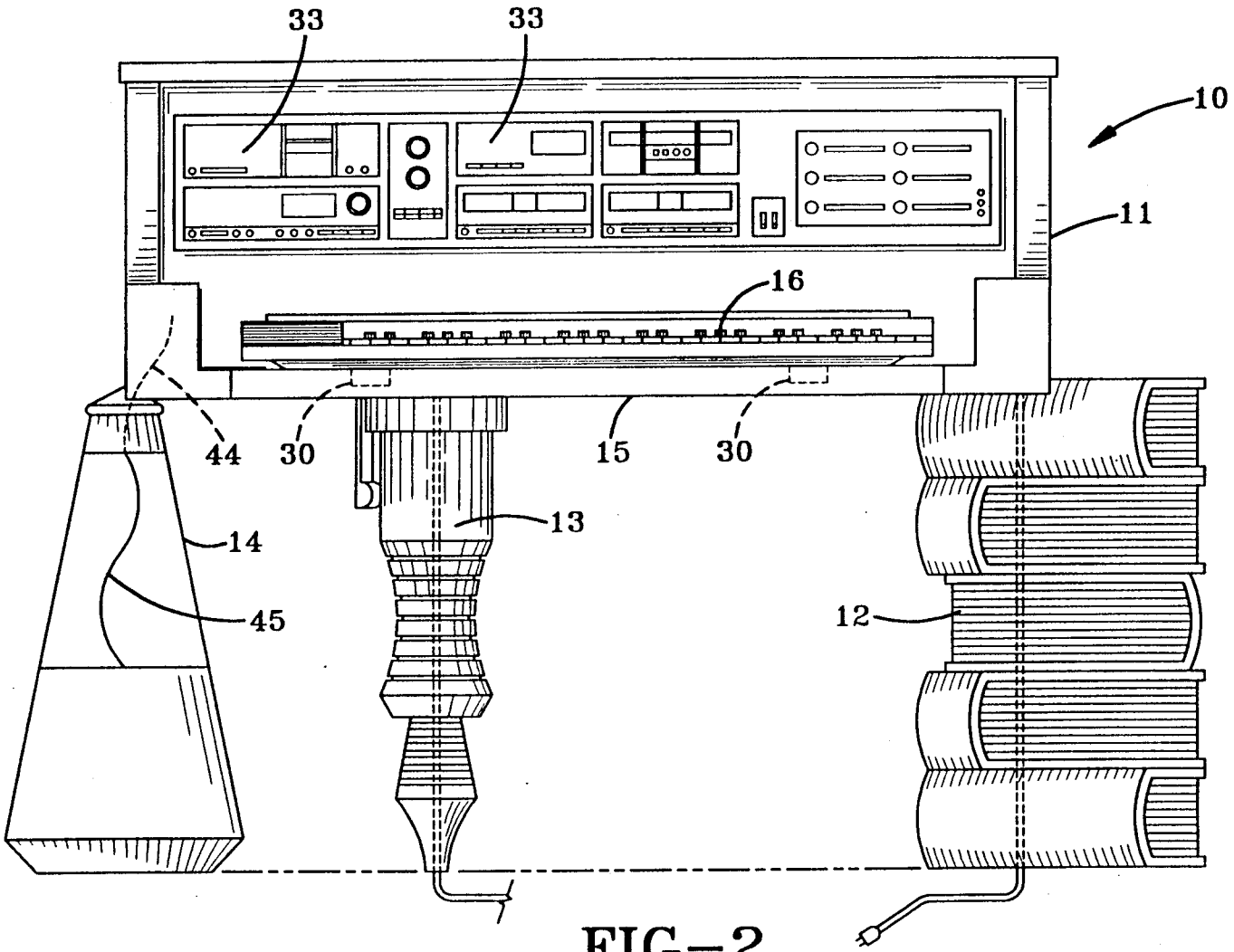
FIG. 2 is a front elevation illustrating the electronic piano cabinet construction of the present invention.
Figure 3:
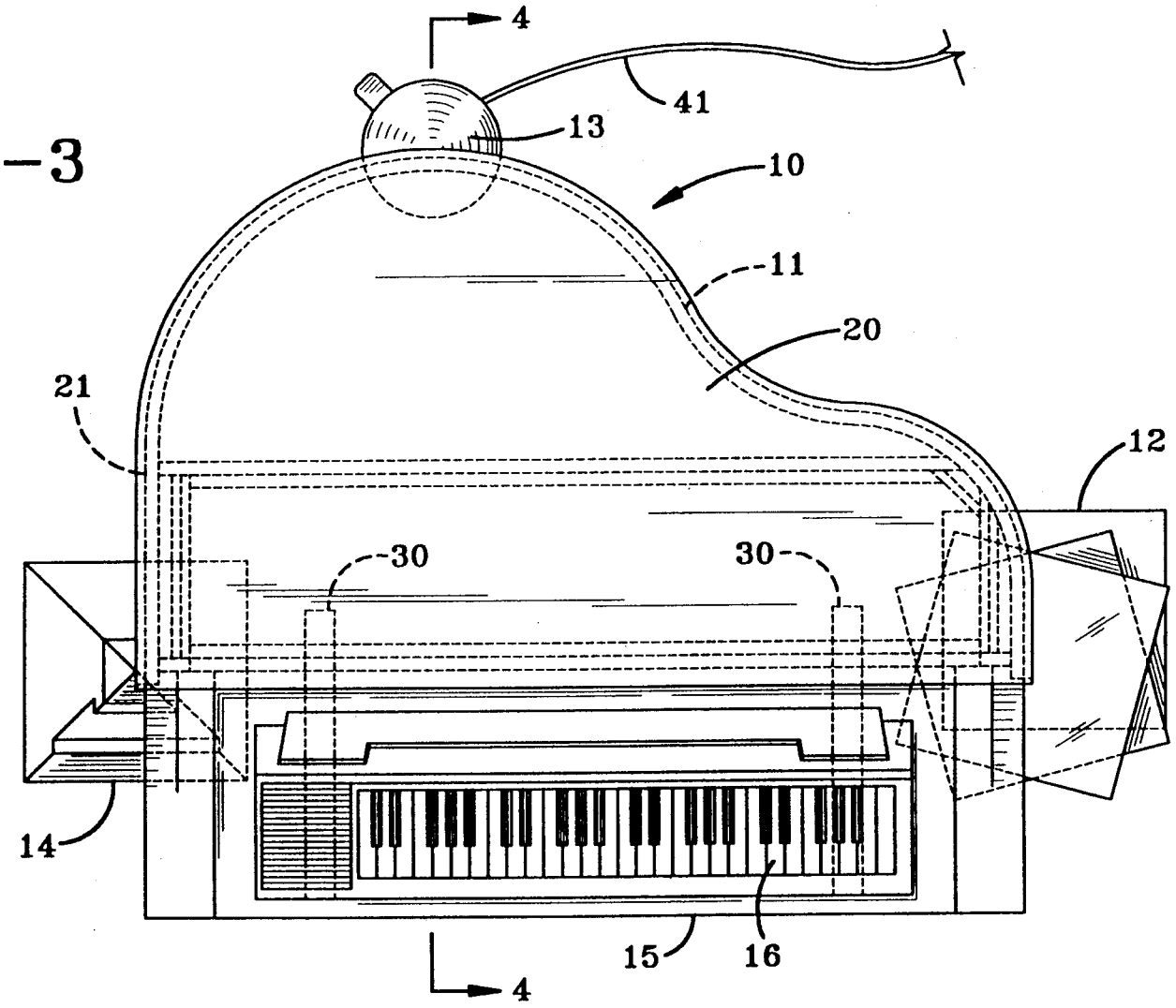
FIG. 3 is a top plan view of the construction of FIGS. 1 and 2.

In accordance with the present invention, housing cabinet 11 is provided with fiber optic visual display equipment. A light generating member is diagrammatically illustrated at 40 and is connected to a fiber optic member 41 that extends from generating member 40 through an opening formed in rear wall 18 and downwardly through a conduit 42 formed through rear leg 13. Fiber optic member 41 may extend to any desired location and may, for example, be mounted in a groove formed in the surface of the floor (not shown) on which the equipment is located and embedded in the groove so as to provide a visual display that is visible to an observer close to the equipment. Similarly, a second fiber optic output member may be located on the left front leg 14, as illustrated in FIGS. 1 and 2, with fiber optic member 51 being attached and communicating with light generating member 40. The left front leg 14 includes a conduit 44 which communicates with the interior of the cabinetry and a fiber optic member 45 extends from generating member 40 to leg 14 with a portion of the fiber optic member 45 exposed to provide a visual display.

Right front leg 12 also includes a vertical conduit 60 which communicates with the interior of housing 11 so that power lines may be routed to the interior of the housing 11 through conduit 60 to provide electric power to all the items of electronic equipment housed in the construction.

A fan (not shown) may also be mounted in housing 11 to aid ventilation and supplied with power in the same manner as other items of equipment.

In the drawings, leg members 12, 13 and 14 are illustrated, respectively, as a stack of books, a fountain pen, and a metronome. By forming these legs in such shape, the aesthetic appearance of the construction is enhanced. It is to be understood that any suitable aesthetic design may be used for the legs 12, 13 and 14, or the legs 12, 13 and 14 may be of a plain character. In accordance with the present invention, however, each of the legs 12, 13 and 14 is provided with a conduit that communicates with the interior of the cabinet 11 so that various items of equipment located remote from the cabinet construction may communicate either optically or electrically with items of equipment located within cabinet 11. For example, while not shown, a loud speaker system may be located at a position remote from the location of cabinet 11. The electrical impulse of the sound to be reproduced by the loud speakers may be transmitted to the remotely located loud speakers by extending wire between the electric equipment located in the interior of cabinet 11 through conduits formed in either leg 12, 13 or 14, and through other conduit members which may be located below the floor level or behind a wall in the room where installation is made.

As mentioned above, the interior of the cabinet 11 may be subdivided into a plurality of smaller cabinet enclosures, generally indicated as at 80, 81 and 82. Likewise, shelving members 83 and 84 can be mounted within the interior of cabinet 11 as desired. Storage space will, therefore, be provided for not only the electronic sound producing equipment and the fiber optic generating equipment, but for items of soft ware, such as compact discs or magnetic tape or the like, or any other material that may be used in association with the equipment, such as sheet music.

In the foregoing description, certain terms have been used for brevity, clearness and understanding, but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details of the construction shown or described.

Having now described the features, discoveries and principles of the invention, the manner in which the improved electronic piano cabinet construction is constructed, assembled and operated, the characteristics of the new construction, and the advantageous, new and useful results obtained; the new and useful structures, devices, elements, arrangements, parts, and combinations are set forth in the appended claims.

I claim:

1. Electronic piano cabinet construction for supporting and housing an electronic keyboard and associated visual and audio producing and reproducing equipment including a housing cabinet having a front panel member, a back wall member, a left side wall member, a right side wall member, and a top panel member and a bottom wall member, a plurality of upright leg members removably attached to and extending from the bottom member for supporting the cabinet upon a supporting surface, said front panel member, back wall member, left side member, right side member, top wall member and bottom wall member defining a cabinet housing, a generally horizontally oriented platform member extending from the front panel member and adapted to support keyboard means, means attached between said platform member and bottom panel member for permitting sliding movement of the platform member with respect to said front panel member, each of the plurality of leg members having a conduit formed longitudinally therethrough, said conduits each communicating with the interior of the housing at one end and terminating at a position adjacent to the leg portion that engages the supporting surface, at least one removable shelf member mounted within the housing and said top member being hinged to one of said side members to permit access to the interior of the housing.

2. Electronic piano cabinet construction as defined in claim 1 in which one of said legs includes visual indicia, communication means extending through said conduit formed in said leg, generating means mounted within the housing to operate said visual indicia and said communicating means extending between said visual indicia and said generating means.

3. Electronic piano cabinet construction as defined in claim 1 in which said front panel includes openings formed therein for receiving and mounting sound producing and reproducing means.

4. Electronic piano cabinet construction as defined in claim 1 in which sound producing means is mounted in said housing, in which an electronic keyboard is mounted on said platform, and in which said front panel has an aperture formed therethrough adapted to receive communication means extending between said keyboard means and said sound means mounted in said housing.

5. Electronic piano cabinet construction as defined in claim 1 in which visual display generating equipment is mounted within the housing and connected to optic fiber means, and in which said opetic fiber means extends through the conduit formed at one of the legs and terminates in a position remote from said housing and legs.

6. Electronic piano cabinet construction as defined in claim 1 in which the loud speaker means are located at a position remote from said housing, and in which said housing contains sound producing and reproducing means, and in which wiring extends from said sound producing and reproducing means through the conduit in one of said legs to said loud speaker means to connect said loud speaker means to said sound producing and reproducing means.

* * * * *